US006369306B2

(12) United States Patent
Chapman

(10) Patent No.: US 6,369,306 B2
(45) Date of Patent: Apr. 9, 2002

(54) FRET SYSTEM IN STRINGED MUSICAL INSTRUMENTS

(76) Inventor: Emmett H. Chapman, 6011 Woodlake Ave., Woodland Hills, CA (US) 91367-3238

( * ) Notice: Subject to any disclaimer, the term of this patent is extended or adjusted under 35 U.S.C. 154(b) by 0 days.

(21) Appl. No.: 09/738,121

(22) Filed: Dec. 18, 2000

Related U.S. Application Data

(60) Provisional application No. 60/179,158, filed on Jan. 31, 2000.

(51) Int. Cl.[7] ..... G10D 3/06
(52) U.S. Cl. ..... 84/314 R; 821/293
(58) Field of Search ..... 84/314 R, 293

(56) References Cited

U.S. PATENT DOCUMENTS

| | | | | | |
|---|---|---|---|---|---|
| 3,273,439 | A | * | 9/1966 | Keefe et al. | 84/314 R |
| 3,712,952 | A | * | 1/1973 | Terlinde | 84/314 R |
| 4,221,151 | A | * | 9/1980 | Barth | 84/314 R |
| 4,633,754 | A | * | 1/1987 | Chapman | 84/314 R |
| 4,722,260 | A | * | 2/1988 | Pigozzi | 84/314 R |
| 5,072,643 | A | * | 12/1991 | Murata | 84/293 |
| 5,952,593 | A | * | 9/1999 | Wilder | 84/314 R |

FOREIGN PATENT DOCUMENTS

| | | | |
|---|---|---|---|
| DE | 2553563 | * | 6/1977 |
| GB | 1394346 | * | 5/1975 |
| GB | 1450582 | * | 9/1976 |

* cited by examiner

*Primary Examiner*—Shih-Yung Hsieh
(74) *Attorney, Agent, or Firm*—J. E. McTaggart

(57) ABSTRACT

In a novel fret system for stringed musical instruments, the fret bar can be fabricated from standard square metal stock, typically of stainless steel. Each fret bar is retained in a corresponding transverse channel machined in the fingerboard surface region of the neck/fingerboard with a conforming cross-sectional shape that locates the main portion of the fret bar recessed into the neck/fingerboard with one corner portion extending through the channel opening in the fingerboard surface, thus forming a fret tip of desired height at the apex of a 90 degree angle. The fret bar is inserted endwise into its channel in the neck/fingerboard where it is retained securely. This system has proven beneficial both for the "feel" of playing the instrument in tapping and conventional modes and for precision and uniformity in manufacture. In a preferred embodiment, material is machined from the bottom corner opposite the fret tip, providing a flat bottom surface that enhances support and stability and that can be configured with recessed regions for retaining adhesive applied at assembly, to prevent longitudinal shifting of the fret bars.

20 Claims, 2 Drawing Sheets

FRET SYSTEM IN STRINGED MUSICAL INSTRUMENTS

Benefit is claimed under 35 U.S.C. § 119(e) of pending provisional application no. 60/179,158 filed Jan. 31, 2000.

FIELD OF THE INVENTION

The present invention relates to the field of stringed musical instruments of the guitar and bass guitar family, and more particularly it relates to improvements in the structure of frets, Fret Rods ®, and associated mounting provisions in the neck/fingerboard.

BACKGROUND OF THE INVENTION

Typically a stringed instrument has a neck portion of which one side, herein assumed to be facing upwardly, provides a playing surface known as a fingerboard, above which stretched strings are closely positioned so that a player can set the pitch of a string to a desired note by finger-pressing the string against the fingerboard surface at a corresponding position, thus presetting the length of the vibrating portion of the string and accordingly presetting the frequency of the note then played.

The fingerboard may be made integrally with the neck, typically made of hardwood, or it may be made from a different hardwood or other material and laminated onto the neck. The fingerboard surface may be substantially flat or slightly convex-shaped in cross-section.

Typically fingerboards of instruments in the violin family are made fretless while fingerboards of instruments in the lute family, which includes guitars and bass guitars, are usually fitted with a set of transverse metal frets spaced to provide semitone pitch intervals along the fingerboard. A fingerboard fitted with frets is known as a fretboard.

Usually, the fretboard is finger-stopped with the left hand while the right hand picks, strums and/or plucks the strings; however a special member of the lute family, known as a Stick (R) fretboard tapping instrument, is intended to be played with a technique created by the present inventor in which both hands address the fretboard from opposite sides with all eight fingers oriented at right angles to the fretboard, initiating each note by tapping a string against a fret and holding it there for the desired note duration.

In the lute family, generally, apart from open string notes, the pitch of each note played is set by a string being pressed against the upward extremity, i.e. the fret tip, of a selected fret.

The structure of frets and the system by which they are fastened to the neck/fingerboard to form a fretboard are critical with regard to at least seven parameters:

(1) the actual performance of music, related to fret tip shape and overall uniform accurate alignment of the fret tips in a flat plane close to the strings;

(2) the feel of the instrument to the player, particularly to the fingers: the particular cross-sectional shape of the exposed portion of the frets above the fretboard can be felt by the player's fingers as they move along the strings past the frets in forming notes and expressive nuances, and thus this shape contributes strongly to the overall "feel" of the instrument, which is of great importance to the player;

(3) the aesthetics and general appearance of the instrument;

(4) the producibility including the relative difficulty of assembly and more particularly the effort and time required to level the frets and dress them individually to a satisfactory level of quality;

(5) the long term reliability, including stability and durability, e.g. retention of the frets properly in place over a period of years, and wear along the fret tips;

(6) the maintainability, including the capability and ease of field refurbishment, adjustment and/or replacement of the frets; and (7) overall cost to produce.

DISCUSSION OF KNOWN ART

FIGS. 1A–1H show a cross-section of a portion of a neck/fingerboard 10 of a stringed musical instrument fitted with frets of known art having various cross-sectional shapes.

FIG. 1A shows a fret 12A configured with a widely-used conventional cross-sectional shape found in a great majority of known art. This generally T-shaped cross-sectional shape provides a mounting tine extending downwardly by which the fret 12A is retained in a mounting channel with parallel sidewalls sawed transversely across the neck/fingerboard 10. In original assembly or replacement, the fret 12A is hammered into place, forcing the tine downwardly into the channel between the parallel vertical sidewalls. Typically the tine is made with small barbs on the sides near the bottom end as shown to assist retention.

The neck/fingerboard 10 is typically made of hardwood in quality instruments, and conventional frets 12A are typically made a soft malleable metal alloy such as German silver.

An example of such fret structure is found in U.S. Pat. No. 5,952,593 (FIG. 1A).

Such fret structure and mounting between parallel channel sidewalls fails to provide sufficient positive constraint to hold the fret 12A in place in the neck/fingerboard 10: instead, even with the barbs, the retention of the fret depends on friction deriving from the accuracy of a tight fit, which is subject to manufacturing tolerances and/or aging of the wood. Thus there is an inherent risk, borne out by actual experience, that in time, as the wood in the neck/fingerboard relaxes slightly, the frets can become loose and work upwardly out of place. This problem has been addressed by the use of adhesives and/or the addition of barbs on the tine portion in effort to improve the retention and the lifetime reliability.

The conventional cross-sectional shape of the upper exposed portion of the fret 12A has evolved to the convex top curvature shown, as part of the conventional overall fret structure and mounting system that has become commercially accepted as a practical tradeoff between the seven parameters described above.

Typically, there is deterioration of the frets after a certain amount of playing: the soft frets wear unevenly along the tip as a result of various expressive fingering techniques such as sliding up and down the fretboard and pitch bending by stretching strings sideways along the frets. This unevenness can be accommodated to some extent by resetting the action higher, i.e. relocating the strings further away from the fretboard: however this makes fingering and two-handed string tapping more difficult. Properly reconditioning the instrument for worn frets involves sanding and/or filing the frets down for overall leveling uniformity and, in a luthier's operation known as crowning, re-rounding them as required to restore the original uniform playing action along the fretboard. Frets that are excessively worn or that have worked loose may have to be removed and replaced with new frets that, when installed, will need to be individually dressed.

FIG. 1B depicts a cylindrically-shaped fret 12B fitted into a channel of U-shaped cross-section machined into the neck/fingerboard 10 to provide an exposed arc that corresponds to the exposed fret portion shown in FIG. 1A, and can be inserted downwardly between the parallel portion of the channel sidewalls. An example of the structure shown in FIG. 1B is found in U.S. Pat. No. 4,633,754, granted to Chapman, the present inventor, wherein retention is provided by adhesive in the side gaps in the upper region of the U-shaped channel.

FIG. 1C depicts a cylindrical fret 12C that fits closely into a channel with a cross-section that has no parallel sidewalls; instead it is circular with a gap opening at the top that exposes the exposed arched portion of the fret 12C, which must be inserted endwise into the channel, providing positive fret retention against vertical shifting. Examples of such structure are found in U.S. Pat. No. 3,712,952 (FIG. 2) to Terlinde, British patent 1,394,346 (FIG. 2) to Wood, and in German patent 2,553,563 (FIG. 3) to Kist.

FIG. 1D depicts a version of FIG. 1C with the cylindrical fret 12D retained by flanking inter-fret spacers 10A that form a fingerboard surface layer attached onto neck 10, as in U.S. Pat. No. 4,633,754 by the present inventor.

FIG. 1E depicts a hollow tubular fret 12E in a close-fitting channel formed between inter-fret surface blocks 10A' and retained by a screw traversing a full length support panel 10B fastened onto the main wooden portion of neck 10. An example of such structure is found in U.S. Pat. No. 4,221,151 (FIG. 2) to Barth.

FIG. 1F depicts a fret 12F of substantially triangular cross-sectional shape supported on a flat upper surface of neck 10 and retained in place by closely-fitting fingerboard spacer segments 10B. An example of such structure is found in U.S. Pat. No. 2,553,563 (FIG. 4) to Kist. The acute angle (60 degrees for an equilateral triangle) at the fret tip is found to detract from playing comfort due to excessive steepness of the two flat sidewalls.

FIG. 1G depicts a fret 12G having a generally half round cross-sectional shape retained in a close-fitting channel machined in the neck/fingerboard 10, as shown in British Patent 1,450,582 to Wood.

FIG. 1H depicts a fret 12H having a generally semi-elliptical or "bullet" cross-sectional shape, set in a close-fitting channel machined in neck/fingerboard 10. An example of such structure is found in U.S. Pat. No. 5,072,643 to Murata.

Frets of known art and their mountings such as those described above have been subject to one or more of the above described shortcomings or problems relating to the six parameters listed above.

It is noted that amongst the eight examples described above, only the conventional configuration in FIG. 1A fails to provide positive fret retention in the vertical direction: all of the others represent approaches to overcome this deficiency. Without special precautions or fixes, full round fret shapes such as in FIGS. 1B–1D are vulnerable to rotational shifting of the fret, and with the exception of FIG. 1E, all others shown are vulnerable to longitudinal shifting.

To produce a high quality stringed instrument, even though the retaining channels are machined into the neck/fingerboard as accurately as possible, it has been found necessary to dress the fret tips by sanding and/or filing after installation on the fretboard, so as to align the fret tips in a level plane to obtain the optimal string interface relationship for good playing action, and to then crown the frets as needed.

When the shape of the fret tip is inherently convex as in FIGS. 1A–E, 1G and 1H, such fret optimization is difficult and time-consuming due to the large amount of fret material that must be removed initially to accomplish proper leveling. Furthermore, some frets may be left with an excessively wide flat surface at the fret tip, which must then be individually crowned to preserve pitch accuracy and uniform feel to the fingers.

In contrast to the foregoing common luthier's challenges, excessively steep surfaces on both sides of the fret such as in FIG. 1F, where the angle formed is acute, i.e. less than 90 degrees (60 degrees for an equilateral triangle), tend to detract is from the playing "feel" of the instrument, typically causing bumpy obstructions to expressive finger sliding techniques. As an extreme example in this direction, retractable frets having a rectangular cross-sectional shape with vertical sidewalls are disclosed in U.S. Pat. No. 4,722,260 to Pigozzi.

OBJECTS OF THE INVENTION

It is a primary object of the present invention to provide an improved fret configuration and mounting system for stringed instruments that facilitates individual dressing of the fret tips, which includes leveling and rounding, thus enhancing the performance of music by providing accurate uniform alignment of all fret tips in a flat plane close to the strings, It is an object to configure the fret with a cross-sectional exposed shape that will be judged by players to have a superior tactile "feel" when playing the instrument, including the sensation of greater space for the fingers between the frets.

It is an object to configure and implement the fret and its mounting system in a manner that will benefit the aesthetics and overall appearance of the instrument.

It is an object to configure the fret and its mounting system in a manner that enhances producibility including ease of assembly, overall fret tip leveling and individual fret tip dressing.

It is an object to configure the fret and its mounting system in a manner that keeps flat surfaces at fret tips narrow so as preserve pitch accuracy.

It is an object to make the cross-sectional shape of the frets such that they can be fabricated from stock material in a standard form that is readily available.

It is an object to configure the fret and its mounting system to provide superior long-term reliability, including stability and durability, particularly with regard to fret retention in the neck/fingerboard over a period of years.

It is a further object to provide a fret configuration that is readily maintainable with regard to field refurbishment, adjustment and replacement.

It is a further object to provide a fret retaining system that allows latitude in designating fret height without sacrificing anchoring integrity.

SUMMARY OF THE INVENTION

The above mentioned objects have been satisfied in the present invention of a novel fret configuration that utilizes standard square metal stock, preferably of stainless steel, typically 3/16 inch square, oriented such that the two cross-sectional diagonals are respectively substantially parallel and perpendicular to the fingerboard surface, thus making the fret tip the apex of a 90 degree angle.

Compared to lesser or greater angles, the 90 degree angle at the top corner of the square fret of the present invention has been found to be beneficial both for the "feel" of playing the instrument and for ease of manufacture, and can be retained reliably in channels machined in the neck/fingerboard with a shape that fits the fret closely and provides optimal fret exposure, locating the horizontally diagonal corners beneath the fingerboard surface, positively constrained against upward shifting, by 45 degree inclined channel sidewalls.

The frets, when assembled in place, are readily dressed preferably with a belt sander or file, to accurately level off the fret tips to an even plane for uniform close relationship with the strings. This leaves a flat surface on each fret tip of varying width, but, due to the 90 degree angle, these widths are close to uniform and always narrow enough, typically in the range of a few thousandths of an inch, that pitch is not compromised.

Each fret is then further dressed individually to smoothly round the corners at the edges of the flat surface and thus further improves the playing feel, particularly on those stringed instruments that are intended for the two-handed tapping technique, such as the Chapman Stick product line. Such dressing can often be done in the final polishing process with a hand-held rotary sander.

The nominal 90 degree angle of the square-shaped fret rods has been found to facilitate these manufacturing operations in comparison to the rounded contour presented by frets of known art with convex shapes including conventional (FIG. 1A), round (FIGS. 1B–1E), half round (FIG. 1G) and semi-elliptical (FIG. 1H).

The nominal 90 degree angle has also been found to improve playability in comparison to more acute angles such as 60 degrees as shown in FIG. 1F.

The bottom corner opposite the fret tip may be optionally machined to remove material since the shape there is non-critical. A preferred five-faceted embodiment is made to have a flat bottom facet 0.15 inch wide: this provides the fret with good base support when the channel is shaped to closely fit the fret, and preserves neck strength by permitting shallower channel cuts.

BRIEF DESCRIPTION OF THE DRAWINGS

The above and further objects, features and advantages of the present invention will be more fully understood from the following description taken with the accompanying drawings, in which.

DETAILED DESCRIPTION

FIGS. 1A–1H have been discussed above in connection with frets of known art.

Figure 1A:
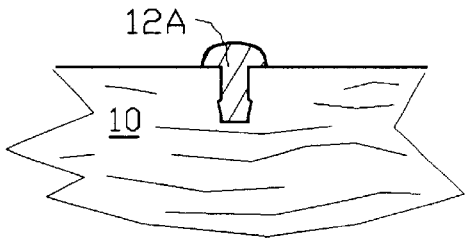
FIG. 1A PRIOR ART
FIGS. 1A–1H each show a cross-section of a portion of a neck/fingerboard of a stringed musical instrument fitted with frets of various cross-sectional shapes of known art as discussed above.
Figure 1B:
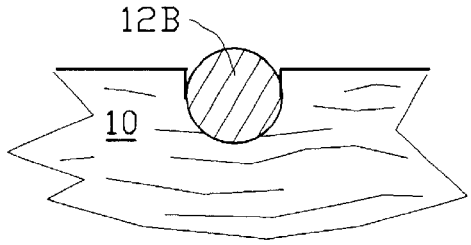
FIG. 1B PRIOR ART
Figure 1C:
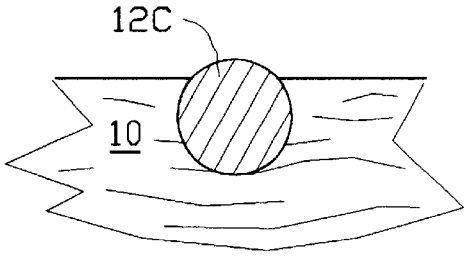
FIG. 1C PRIOR ART
Figure 1D:
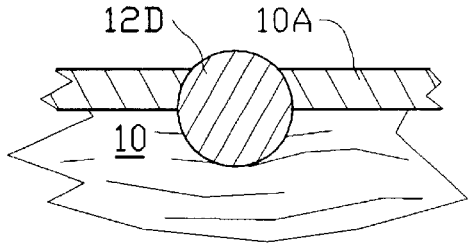
FIG. 1D PRIOR ART
Figure 1E:
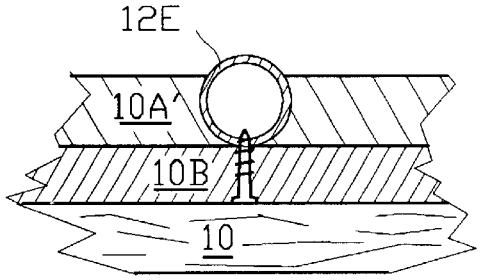
FIG. 1E PRIOR ART
Figure 1F:
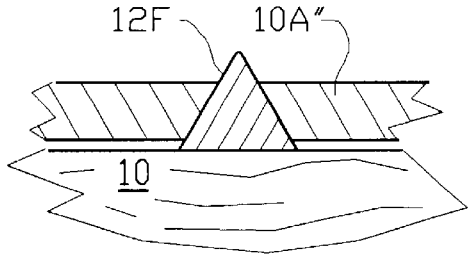
FIG. 1F PRIOR ART
Figure 1G:
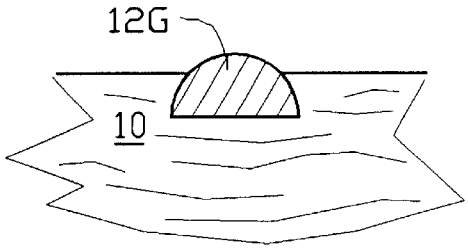
FIG. 1G PRIOR ART
Figure 1H:
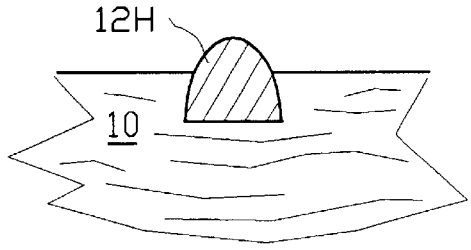
FIG. 1H PRIOR ART
Figure 2A:
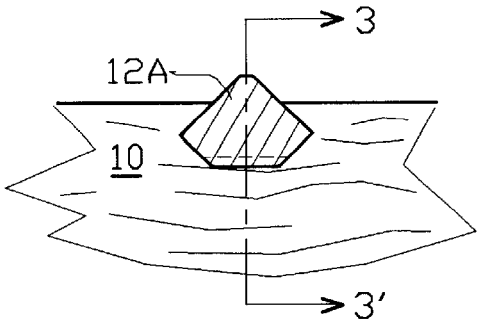
FIGS. 2A–2D each shown a cross-section of a portion of a neck/fingerboard of a stringed instrument fitted with frets of different square-derived cross-sectional shapes in accordance with present invention.

FIG. 2A depicts the cross-sectional shape of a fret 12A of the present invention shaped from square stock to have a flat bottom facet. The resulting five-faceted cross-sectional shape as shown is applied also to a close-fitting five-sided channel machined into the neck/fingerboard 10, where the fret bar is inserted endwise, and is thus positively retained and prevented from migrating upwardly. An optimal portion of the fret 12A, is exposed as the working region including the 90 degree top corner forming the fret tip which, after leveling, is typically left with a narrow flat surface parallel to the fingerboard surface. The fret tips are then rounded off in a dressing procedure as described above, with a typical final fret tip nominal height of 0.055 inch.

Figure 2B:
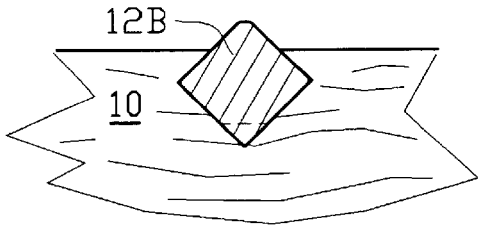

FIG. 2B depicts an embodiment wherein the fret 12B is utilized in the form of the original stock material with a four faceted cross-sectional shape. Minor disadvantages of this configuration are surplus weight in the lower region of the frets 12B, where it provides little or no benefit, deeper channel machining required and possibly weakening the neck/fingerboard 10.

Figure 2C:
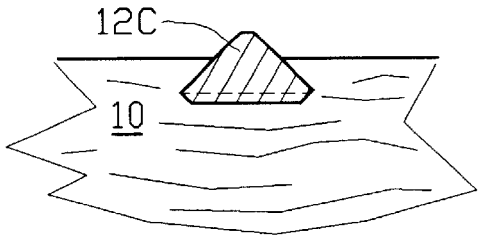

FIG. 2C depicts a fret 12C configured with a cross-sectional shape that features a relatively wide flat bottom facet, approaching as a limit the diagonal dimension of the square stock. The invention could also be practiced in a version of the embodiment shown in FIG. 2C wherein the bottom facet is further widened to equal the diagonal dimension, forming a three-sided (triangular) cross section with a 90 degree apex angle at the fret tip.

Figure 2D:
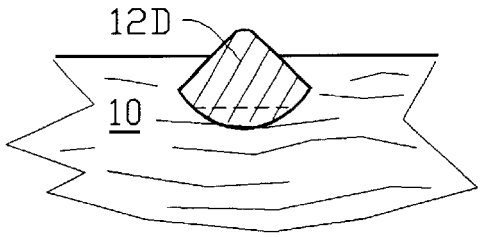

FIG. 2D depicts a fret 12D configured with a cross-sectional shape featuring a generally rounded convex bottom surface having an outline that falls within the original square shape of the stock material.

In each of the four embodiments shown (FIGS. 2A–2D) the fret is fitted into a mating channel, machined in the neck/fingerboard 10, that is shaped in cross-section to conform closely with the shape of the fret, and that is dimensioned to provide a snug friction fit.

Figure 3:
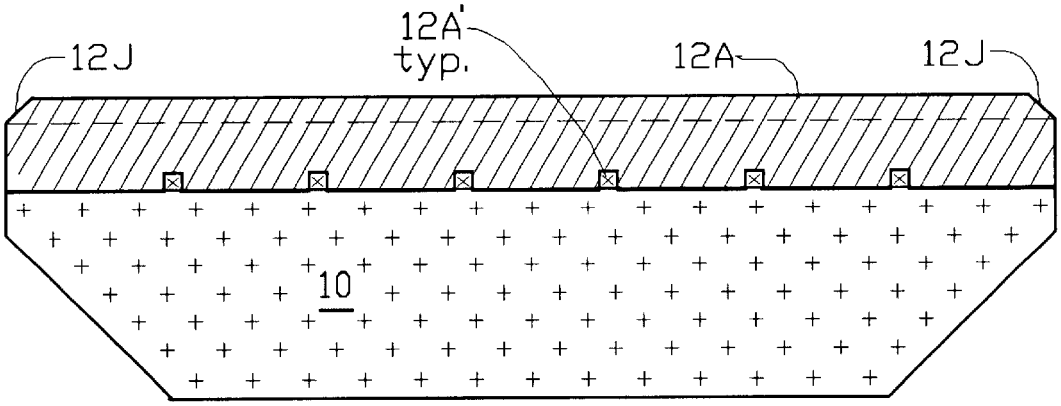
FIG. 3 is a cross-section taken through axis 3–3' of FIG. 2A showing optional void regions to serve as adhesive-retaining slots.

These four embodiments, each derived from common square stock, can be considered functionally equivalent for practical purposes: visually the only difference would be the shape variations at the fret ends, which are typically left visible, but finished off flush with the adjacent surfaces of the neck/fingerboard, as indicated in FIG. 3.

The inventor's research and experience with square type frets in accordance with present invention, such as those disclosed above, revealed that a merely frictional fit in the channel, no matter how tight, while it will inherently retain the fret bar against vertical shift and rotation, may eventually fail to adequately anchor the fret longitudinally due to unavoidable manufacturing tolerances and wood aging properties.

FIG. 3 is a cross-section taken through axis 3–3' of FIG. 2A showing optional void regions provided at the bottom facet of the fret 12A as a set of slots oriented parallel to the strings; these are intended to serve as adhesive-retaining slots to enhance longitudinal retention of the fret bars by ensuring that sufficient adhesive gets delivered to the inner regions of the fret/channel interface when the fret is initially pushed longitudinally into the channel; otherwise the adhesive may be mostly pushed out of the channel.

The upper extremity outline of the adhesive-retaining slots 12A' of FIG. 3 are indicated as dashed lines in FIGS. 2A–2D.

In FIG. 3, it is seen that material has been removed to bevel both ends 12J of the fret tip region of fret bar 12A down to the level of the fingerboard surface: this eliminates potential personal injury from the original sharp corners. As an alternative to the beveled shape shown, these ends 12J could be rounded or otherwise softened in shape.

The invention can be practiced with various alternative ways of constraining the fret longitudinally, including mechanical solutions such as screw or other attachments located beneath the playing surface (FIG. 1E), end caps, moldings or the like, altering the surface structure of the fret in various portions and regions thereof so as to retain adhesive, e.g. drilled cavities, channels, scratch marks and roughened surfaces of various shapes, sizes and locations. Striations from a coarse sanding operation, running transversely across the fret bar, are considered to be highly viable in this regard. There can be considerable flexibility regarding particular location on the fret of adhesive and of adhesive retention treatment, however all such treatment must be made compatible with protecting and preserving the finish of the exposed fret surfaces.

The invention could be practiced with other cross-sectional fret shapes derived from square stock; for example instead of a flat bottom facet as in FIGS. 2A and 2C, the bottom could be made concave, i.e. to arch upwardly.

As an alternative to making the fret bar from square material stock, the invention could be practiced utilizing other cross-sectional shapes, and forming angles other than 90 degrees that could be considered practically equivalent: e.g. material could be extruded either to the final shape desired or to a preliminary shape to be further altered to the final shape.

As an alternative to a flat fretboard as described above in connection with particular embodiments, the invention may also be practiced with a fretboard with a playing surface having a convex cross sectional shape: the fret bars would need to be arched accordingly, either by preformed/molded metal or ceramic materials, pre-bending standard stock such as stainless steel, or utilizing a flexible material such as nylon or other plastic material.

This invention may be embodied and practiced in other specific forms without departing from the spirit and essential characteristics thereof. The present embodiments therefore are considered in all respects as illustrative and not restrictive. The scope of the invention is indicated by the appended claims rather than by the foregoing description. All variations, substitutions, and changes that come within the meaning and range of equivalency of the claims therefore are intended to be embraced therein.

What is claimed is:

1. An improved fret system for incorporation into a stringed musical instrument having a neck/fingerboard providing a fingerboard surface, said fret system comprising:

a plurality of elongate fret bars of durable material each having a cross-sectional shape having first and second facets adjoining each other at a first corner, forming an angle within a range of 80 degrees to 120 degrees, designated to be a fret tip; and a corresponding plurality of fret channels each configured transversely in the neck/fingerboard forming a gap of designated width in the fingerboard surface at a desired fret location and each shaped cross-sectionally to conform to a corresponding portion of the cross-sectional shape of said fret bars, and to thus accept a corresponding one of said fret bars inserted longitudinally, and to retain said fret bars with a portion of each of the first and second facets disposed and retained beneath the fingerboard surface, and with a remaining portion thereof extending through the gap, including the fret tip at the first corner located at a designated fret height above the fingerboard surface, thus constituting a fret for playing strings of the instrument.

2. The improved fret system as defined in claim 1 wherein each fret channel is configured so as to orient the first and second facets of each of the fret bars symmetrically thus forming equal angles with the fingerboard surface.

3. The improved fret system as defined in claim 2 wherein, in the cross-sectional shape of each of the fret bars, the first and second facets are made to form substantially a right angle with each other, thus forming angles of substantially 45 degrees with the fingerboard surface.

4. The improved fret system as defined in claim 3 wherein said frets bars are made to have a cross-sectional shape having a major portion of a square including the first, second and third corners, the first and second facets being full sides of the square, third and fourth facets being partial sides of the square extending from the second and third corners to fourth and fifth corners, and a fifth facet extending between the fourth and fifth corners, thus interfacing a bottom channel surface beneath the fingerboard surface.

5. The improved fret system as defined in claim 4 wherein the fifth facet is made to be flat and substantially parallel with the fingerboard, the third and fourth facets being substantially equal in width and the fourth and fifth corners each having an angle of substantially 135 degrees.

6. The improved fret system as defined in claim 4 wherein, in each of said frets bars, the fifth facet is made be substantially 0.150 inch in width.

7. The improved fret system as defined in claim 1 wherein the cross-sectional shape of each of the fret bars further characterized by a second corner and a third corner defining extremities of the first facet and the second facet respectively.

8. The improved fret system as defined in claim 7 wherein said fret bars are made to have a cross-sectional shape that is substantially square having the first and second facets as two adjacent sides thereof.

9. The improved fret system as defined in claim 1 wherein, in each of said frets bars, the first and second facets are each made to be substantially 3⁄16 inch in width.

10. The improved fret system as defined in claim 1 wherein said fret bars are made from stainless steel.

11. The improved fret system as defined in claim 1 wherein said fret bars are secured in place in said channels by pre-application of an adhesive in interfacing regions, and wherein a selected surface portion of the fret bars is configured with small recessed cavity regions for retaining the adhesive and enhancing holding action thereof.

12. The improved fret system as defined in claim 1 wherein said bars, after installation in place, are finalized for service as frets by abrasively dressing the fret tip for uniform height then rounding the edges of resulting flat surfaces by abrasive polishing, thus shaping the fret tip for optimal interaction with the strings and fingers when the instrument is played.

13. The improved fret system as defined in claim 1 wherein said channels are located and dimensioned such that each fret tip is made to have a height in a range between 0.04 and 0.08 inch relative to the fingerboard surface.

14. A method of incorporating frets in a stringed musical instrument having a neck/fingerboard with a region thereof configured as a fingerboard surface, comprising the steps of:

(1) preparing a plurality of fret bars, each cut to required length from metal stock originally having a square cross-sectional shape and thus having four facets;

(2) machining a series of retaining channels traversing the neck/fingerboard at required fret locations in the fingerboard surface, each channel having a cross-sectional shape conforming to a major portion of the cross-sectional shape of each of the fret bars and being located and oriented to receive and retain each of the fret bars and to provide a gap in the fingerboard surface through which a designated corner portion of each of the fret bars extends forming fret tips, one for each of the fret bars including a portion of each of the first and second facets, to serve as a fret for playing the instrument;

(3) inserting each of the fret bars longitudinally into a corresponding one of the retaining channels.

15. The method of incorporating frets in a stringed musical instrument as defined in claim 14 further comprising the additional steps of:

(4) abrasively dressing the fret tips collectively substantially parallel to the fingerboard surface for uniform height, and (5) rounding the edges of resulting flat surfaces at the fret tips by abrasive polishing, thus finishing the fret tips for optimal interaction with the strings and fingers when the instrument is played.

16. The method of incorporating frets in a stringed musical instrument as defined in claim 15 further comprising the additional step of:

(6) trimming ends of each fret bar to conform with adjacent side surfaces of the neck/fingerboard.

17. The method of incorporating frets in a stringed musical instrument as defined in claim 16 further comprising the additional step of:

(7) removing material at each end of each of the fret bars in a region above the fingerboard surface so as to eliminate sharp corners and thus avoid potential personal injury.

18. The method of incorporating frets in a stringed musical instrument as defined in claim 17 wherein the material is removed at each end of each of said fret bars in a manner to form a beveled surface in the region above the fingerboard surface.

19. The method of incorporating frets in a stringed musical instrument as defined in claim 14 comprising in step (1) the additional sub-step of:

(1A) modifying the square original cross-sectional shape of the fret bars by machining one corner of each of the fret bars, diagonally opposite a corner designated as the fret tip, such that, in the cross-section, a fifth facet is flanked by third and fourth adjacent facets representing partial sides of the original square shape, each disposed at an angle of substantially 135 degrees relative to the fifth facet.

20. The method of incorporating frets in a stringed musical instrument as defined in claim 14 further comprising an additional sub-step in step (1) and a preliminary sub-step in step (3) of:

(1B) modifying appropriate surface areas of the fret bars, including at least the fifth facet, so as to provide recessed cavity regions for retaining adhesive; and (3A') prior to step (3), applying adhesive to portions of said surface areas selected from intended interfacing areas of the fret bars and the retaining channels, particularly at the flat fifth facet, so as to secure the fret bars in place by adhesive setting after insertion into the corresponding retaining channels.

* * * * *

UNITED STATES PATENT AND TRADEMARK OFFICE

CERTIFICATE OF CORRECTION

PATENT NO. : 6,369,306 B2
DATED : April 9, 2002
INVENTOR(S) : Emmett H. Chapman

It is certified that error appears in the above-identified patent and that said Letters Patent is hereby corrected as shown below:

Column 1,
Line 11, delete "®" and insert therefor -- ™ --.

Column 2,
Line 31, delete "5,932,593" and insert therefor -- 5,932,595 --.

Column 3,
Lines 22 and 23, delete ", as in U.S. Pat. No. 4,633,754 by the present inventor".

Signed and Sealed this

Twenty-fourth Day of December, 2002

JAMES E. ROGAN
*Director of the United States Patent and Trademark Office*